United States Patent [19]

Thurmond, Jr.

[11] 4,213,647

[45] Jul. 22, 1980

[54] DRUM LIFTER

[75] Inventor: Elmer T. Thurmond, Jr., Miami, Fla.

[73] Assignee: Equipment Company of America, Hialeah, Fla.

[21] Appl. No.: 897,577

[22] Filed: Apr. 19, 1978

[51] Int. Cl.[2] ..... B66C 1/66

[52] U.S. Cl. ..... 294/90; 294/104

[58] Field of Search ..... 294/15, 31 R, 90, 92, 294/101, 104

[56] References Cited

U.S. PATENT DOCUMENTS

| | | | |
|---|---|---|---|
| 3,330,591 | 7/1967 | Pavelka | 294/90 |
| 3,333,883 | 8/1967 | Kikuchi | 294/90 |
| 3,794,371 | 2/1974 | Arbouw | 294/90 |

FOREIGN PATENT DOCUMENTS

| | | | |
|---|---|---|---|
| 442137 | 12/1974 | U.S.S.R. | 294/90 |

*Primary Examiner*—Johnny D. Cherry

*Attorney, Agent, or Firm*—Cullen, Sloman, Cantor, Grauer, Scott & Rutherford

[57] ABSTRACT

A drum lifter which provides no-tilt, self-energizing lifting of both closed head type or open-head with completely removable top head type drums. Two arms are pivotally connected at a unique location, and each arm has specially designed gripping surfaces for engaging the drum during a lifting operation.

1 Claim, 5 Drawing Figures

F
9
11
20
6
12
25
16
13
7
3
3
17
4
4
22
21
22
21
8
10
15
14
5
5
15
14
24
25
12
18
10
11
17
25
19
18
12
25
21
10
15
11
17
25
19
7

DRUM LIFTER

BACKGROUND OF THE INVENTION

A problem has existed in providing a simple and inexpensive drum lifting device which can be quickly attached to a crane, fork truck, or the like for lifting shipping drums. Steel shipping drums or barrels are used for shipping commodities such as chemicals, paints, janitorial supplies, and food products. One of the more commonly used drums has a capacity of fifty-five gallons. One man is not able to move such large shipping drums without the aid of a tool such as a drum lifter or the like.

The drum lifter must be simple to use, inexpensive, and perform at least two functions. The drum lifting device must keep the drum relatively upright when it is lifted off the ground for various reasons such as keeping the contents of the drum from shifting or permitting easier placement of the drum on an elevated storage area. The drum lifter also must be self-energizing or capable of handling various drum weights with gripping strengths proportional to the weights of the drums. The holding or gripping force necessary to suspend a twenty-five-gallon drum containing paint, for example, is not sufficient to suspend a fifty-five gallon drum containing a like material. As the drum gets heavier, the same drum lifter must be capable of holding the additional weight.

An additional problem with some prior drum lifters such as shown in U.S. Pat. No. 3,333,883 is that the gripping force tends to be concentrated directly on the upper drum chime. This is detrimental for an open-head drum that has a locking ring to hold a removable top head because the gripping force could pull the locking ring off the drum.

SUMMARY OF THE INVENTION

A barrel and drum handling apparatus is disclosed which is simple to operate, inexpensive, and quickly attachable to a crane, forklift, or the like. The drum lifter of the present invention consists of only two arms which are pivotally mounted together. One arm has a gripping portion that engages the underside of an upper drum chime while the other arm has a gripping portion that engages the top head of the drum. Unlike the aforementioned U.S. Pat. No. 3,333,883, the gripping portions of the present invention are designed for holding either a closed head type or open head with locking ring type drum in suspended position.

A general feature of the present invention is to provide a simple and inexpensive two arm device which can be quickly attached to a crane, fork truck, or the like. The drum lifter can be quickly positioned on a drum and set to securely grip the drum when a lifting force is applied to one arm of the two arm arrangement. Because of the design of the gripping surfaces, the pivot point for the arms, and design of the arms, the drum lifter of the present invention lifts either a closed head or open head with completely removable top head type drum without tilting it substantially. This no-tilt feature is important when positioning the drum into certain locations, for example, on a rack several feet off the ground. The drum lifter is also self-energizing so that the heavier the load, the tighter the grip. The no-tilt and self-energizing features of the present invention permit a one-man drum lifting operation with any overhead lifting system.

A feature of the present invention is the design of the pivoted arms. One of the arms is a lifting arm which has a generally rectangular body portion with a short arm portion on one end. The longitudinal axis of the short arm portion is transverse to the longitudinal axis of the body portion. The short arm portion has a gripping surface engaging the underside of an upper drum chime. The other end of the lifting arm has an opening to receive the hook from a crane or the like. A second arm used for stabilizing has an elongated body portion with a stabilizing pad on one end and bifurcated portions on the other end. The bifurcated portions are attached to a second gripping portion which sets on the top head of a drum when the drum lifter is positioned for operation. The lifting arm is pivoted to the stabilizer arm on a pivot axis that lies between the bifurcated portions of the stabilizer arm.

The location of the pivot axis between the lifting arm and stabilizing arm is important to the overall operation of the drum lifter. In aforementioned U.S. Pat. No. 3,333,883, a link or locking lever is provided to keep the lifting arms from separating. A locking lever is not necessary in the present invention. When the drum lifter is set to lift, the pivot axis lies in a plane that substantially bisects the drum chime upon the lifter acts. The pivot axis is the fulcrum point for the lifting arm, and it is supported by the second gripping portion that sits flatly on the top head of the drum and the bifurcated portions. The lifting arm and stablilizing arm cannot separate from each other during lifting because one gripping portion is held to the underside of the drum chime and the second gripping portion sits squarely on the top head of the drum. The need for a locking lever is eliminated because of the gripping surfaces, lifting arms, and stabilizing arm of the present invention plus the uniquely located pivot axis between the lifting and stabilizing arms. The same features also prevent tilting of the drum when it is suspended. Finally, the heavier the drum, the greater will be the gripping force between the gripping portions.

The various objects and advantages of the present invention, together with other objects and advantages which may be attained by its use, will become more apparent upon reading the following detailed description taken in conjunction with the drawings.

DETAILED DESCRIPTION OF THE INVENTION

Figures 1, 2, 3, 4, 5:
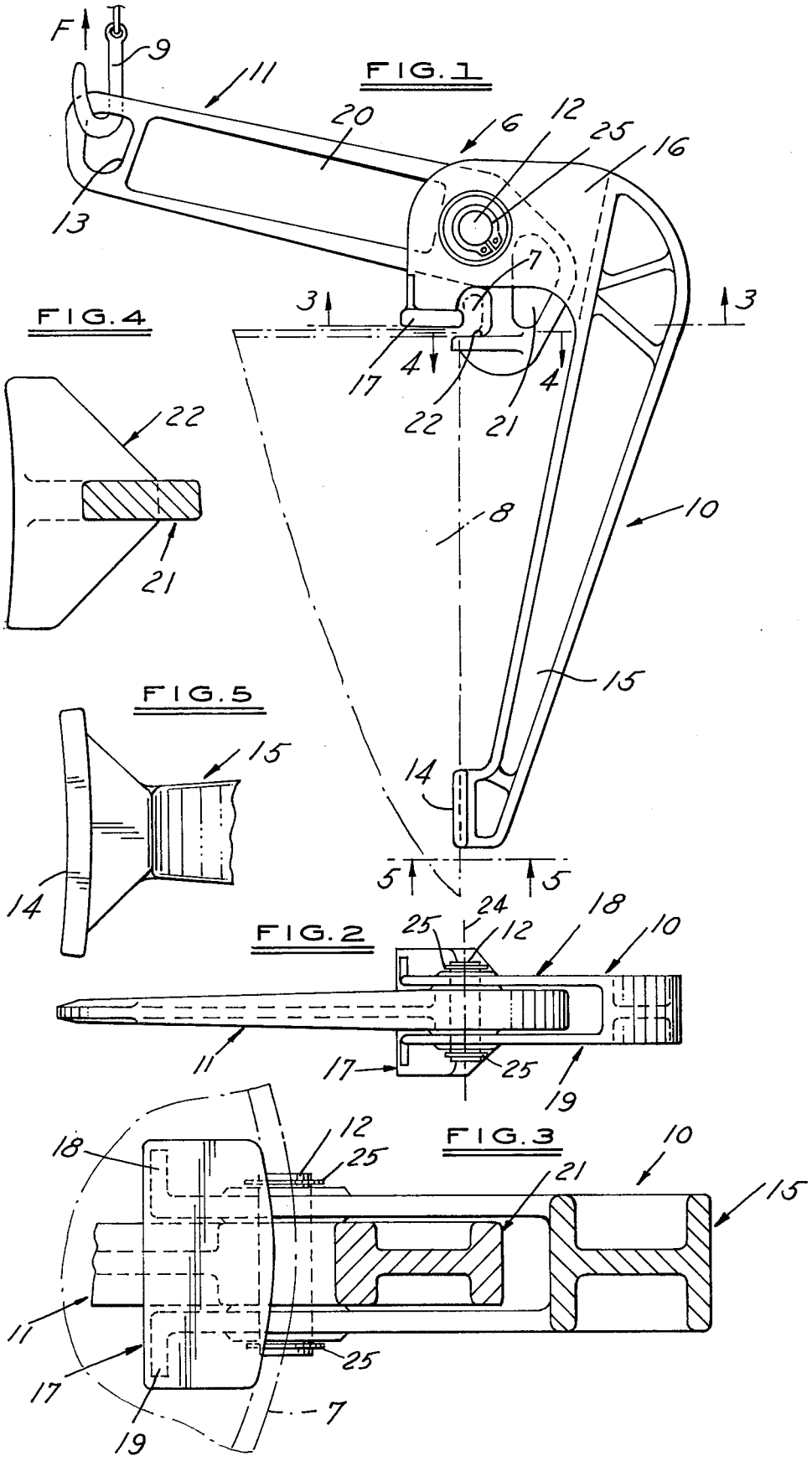
FIG. 1 is a side elevation view of the drum lifter in an operative work position on the drum.
FIG. 2 is a top elevation view of the drum lifter shown in FIG. 1.
FIG. 3 is a cross-sectional view taken along line 3—3 of FIG. 1 showing the relative position of the arms and one of the gripping surfaces.
FIG. 4 is a cross-sectional view taken along line 4—4 of FIG. 1 showing a second gripping surface.
FIG. 5 is a detailed view taken along line 5—5 of FIG. 1 showing a stabilizing surface or pad on the stabilizer arm.

Referring to FIG. 1, the drum lifter 6 is shown gripping about upper drum chime 7 of a drum 8. Drum lifter 6 comprises an L-shaped stabilizer or stabilizing arm 10 pivoted to an L-shaped lifting arm 11 by a pivot pin 12.

As shown in FIG. 1, a lifting force F has been applied to lifting arm 11 at opening 13. This lifting force may be applied by any suitable means including, for example, a hook 9 inserted in opening 13 where the hook is connected to an overhead lifting apparatus such as a crane. The stabilizer arm 10 has a lower stabilizing pad 14, an elongated arm portion 15, a short, wide arm portion 16, and a gripping pad 17. The short, wide arm portion 16 is bifurcated into support portions 18 and 19 (FIG. 2). Lifting arm 11 has an elongated arm portion 20, a short arm 21, and a gripping surface 22.

Long arm portion 15 of L-shaped stabilizer arm 10 has on one end a gripping surface or stabilizing pad 14. Pad 14 is arcuate along its width as shown in FIG. 5, to conform to the side of the drum, and it is also generally rectangular in shape. Short arm portion 16 is bifurcated into support portions or sections 18 and 19, as shown in FIG. 2. A gripping pad or surface 17 is mounted to the ends of support portions 18 and 19. Referring to FIG. 3, gripping pad 17 is arcuate along one side to abut the inside of drum chime 7. Gripping surface 17 is generally rectangular and flat with the exception of its one arcuate side.

L-shaped lifting arm 11 is comprised of elongated arm portion 20 and short arm portion 21. Arm portion 20 has an opening 13 on one end thereof for receiving, for example, a hook 9 from a crane to apply a lifting force F. Arm portion 21 has on one end a gripping surface 22, as shown in FIG. 4. Gripping surface 22 has a large area for engaging the underside of the drum chime 7. L-shaped stabilizer arm 10 is pivotally connected to L-shaped lifting arm 11 by pivot pin 12. As shown in FIG. 2, L-shaped lifting arm 11 is pivotally connected between bifurcated support portions or sections 18 and 19 of L-shaped stabilizer arm 10.

One of the features of the present invention is that gripping pad or surface 17 sits flatly on the top head of the drum 8 and does not grip the drum chime 7. The drum lifter 6 of the present invention is used to lift both closed head type and open head with locking ring type drums. In that the pad 17 does not grip the drum chime 7, there is substantially less likelihood that the drum lifter 6 will pull the locking ring off the top head.

The pivot pin 12 has a centrally located axis or pivot axis 24 as shown in FIG. 2.

The location of the pivot axis 24 of pivot pin 12 is important so that when the drum 8 is lifted it does not tilt and the need for a locking mechanism between arms 10 and 11 is eliminated. The horizontal coordinate for the location of the pivot pin 12 is taken from longitudinal axis of the drum 8. With the drum lifter 6 in operative position, as shown in FIG. 1, a plane through the center of pivot pin 12 containing axis 24 will generally bisect the drum chime 7. The vertical coordinate for the pivot axis 24 is generally midway on short arm portion 16 between gripping pad 17 and the top of stabilizer arm 10. Since the gripping pad 17 sits squarely on the top head of the drum 6 and the pivot pin 12 is the fulcrum for the lifting arm 11, there are substantially no horizontal force components that would tend to separate the lifting and stabilizing arms 10 and 11. Consequently, there is no need for a locking lever or link between arms 10 and 11.

Referring to FIG. 1, when a vertical force F is applied to lifting arm 11, two reaction vertical forces are produced. A first reaction force is between gripping pad 17 and the top head of drum 8, and a second reaction force is between gripping surface 22 and the underside of drum chime 7. When the force F increases due to a heavier drum, then the reaction force is also increased thereby making the gripping action greater. One feature of the invention is the heavier the drum, the tighter the grip becomes between stabilizing arm 10 and lifting arm 11.

The stabilizing arm 10 and lifting arm 11 grip drum 8 about drum chime 7 and hold it suspended without tilting it from its upright position. As shown in FIG. 1, the lifting arm 11 extends inwardly to a point that lies on the longitudinal axis of the drum 8. The long arm portion 15 of the stabilizing arm 10 is sized to substantially stabilize the drum 8 against any horizontal turning moments when suspended. By locating the pivot pin 12 slightly above the drum chime and substantially in line with it, the turning moment on the drum 8 tends to keep the drum 8 upright during lifting.

External retaining rings 25 are carried by the ends of the pivot pin 12 as shown in FIGS. 1, 2 and 3 to maintain the arms 10 and 11 assembled on the pivot pin 12.

The foregoing is a complete description of the preferred embodiment of the present invention. Various changes may be made without departing from the spirit and scope of the invention. The invention, therefore, should be limited only by the following claims.

What is claimed is:

1. For a drum having a shell, top and bottom ends, and a drum chime extending outwardly from each end, a drum lifter for suspending said drum, said drum lifter comprising a lifting arm pivotally connected to a stabilizing arm by a pivot pin, said pivot pin having a pivot axis, said lifting arm being generally L-shaped and having a long arm portion and a short arm portion, the longitudinal axis of said long arm portion being generally transverse to the longitudinal axis of said short arm portion, said lifting arm having a gripping surface on one end and an opening on its other end, said stabilizing arm being generally L-shaped and having an elongated arm portion and a short wide arm portion, the longitudinal axis of said elongated arm portion being generally transverse to the longitudinal axis of said short wide are portion, said short wide are portion being bifurcated into support sections, a flat gripping pad being mounted to the ends of said support sections, a stabilizing pad being mounted to one end of said stabilizing arm, said pivot pin passing through said lifting arm and being pivotally mounted to each of said support sections of said short wide arm portion of said stabilizing arm, said pivot pin axis being located directly above one of said drum chimes when said drum lifter is positioned for lifting of said drum and a lifting force being applied to said opening in said long arm portion, and a plane through the pivot axis of said pivot pin being parallel to the longitudinal axis of said drum and substantially bisecting said one drum chime, said flat gripping pad of said stabilizing arm applying substantially only a vertical bearing force against the end of said drum near said one drum chime, and said gripping surface of said lifting arm applying only a vertical force against the underside of said one drum chime, said vertical force against the end of said drum and said vertical force against the underside of said one drum chime substantially eliminating any horizontal force components against said one drum chime.

* * * * *